US008280298B2

(12) United States Patent
Kougami

(10) Patent No.: US 8,280,298 B2
(45) Date of Patent: Oct. 2, 2012

(54) SHEET HUMIDIFYING DEVICE AND IMAGE FORMING SYSTEM PROVIDED THEREWITH

(75) Inventor: Masashi Kougami, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 650 days.

(21) Appl. No.: 12/399,564

(22) Filed: Mar. 6, 2009

(65) Prior Publication Data

US 2009/0229515 A1 Sep. 17, 2009

(30) Foreign Application Priority Data

Mar. 13, 2008 (JP) ..... 2008-063884

(51) Int. Cl.
*B41F 23/02* (2006.01)
*B05C 1/08* (2006.01)
*G03G 21/00* (2006.01)

(52) U.S. Cl. ..... 399/407; 162/DIG. 6

(58) Field of Classification Search ..... 101/419, 101/420, 180, 220, 221, 182, 184, 185, 249; 118/695, 111, 112, 113, 114, 116, 248, 251; 399/407, 97, 44, 67–69, 341; 347/212; 162/265, 162/270, 271, 134, 207, DIG. 6; *D21G 7/00; B41F 23/02; B41J 29/70*

See application file for complete search history.

(56) References Cited

U.S. PATENT DOCUMENTS

| | | | | |
|---|---|---|---|---|
| 5,987,301 | A | 11/1999 | Acquaviva | |
| 2006/0109303 | A1 * | 5/2006 | Wolf et al. | 347/34 |
| 2007/0240640 | A1 * | 10/2007 | Shida et al. | 118/258 |

FOREIGN PATENT DOCUMENTS

| | | | |
|---|---|---|---|
| JP | 11-161107 | A | 6/1999 |
| JP | 2007-058026 | A | 3/2007 |
| JP | 2007-292914 | A | 11/2007 |

OTHER PUBLICATIONS

English Machine Translation of JP 2007-058026, published Mar. 8, 2007.*

English Machine Translation of JP 2007-058026 published Mar. 8, 2007.*

Japanese Office Action dated Jan. 31, 2012 (and English translation thereof) in counterpart Japanese Application No. 2008-063884.

* cited by examiner

*Primary Examiner* — Judy Nguyen
*Assistant Examiner* — Ruben Parco, Jr.
(74) *Attorney, Agent, or Firm* — Holtz, Holtz, Goodman & Chick, PC

(57) ABSTRACT

A sheet humidifying device includes a pair of humidifying rollers which form a nip portion by pressure contacting against each other and giving water to a sheet passing through the nip portion, a water-supply roller that pressure contacts the humidifying roller and supplies water to the humidifying roller, a water vessel that stores water to be supplied to the water-supply roller, and a pressure-contact releasing section that releases pressure-contact of the pair of humidifying rollers and releases pressure-contact between the humidifying roller and the water-supplying roller.

4 Claims, 5 Drawing Sheets

SHEET HUMIDIFYING DEVICE AND IMAGE FORMING SYSTEM PROVIDED THEREWITH

This application is based on Japanese Patent Application No. 2008-063884 filed on Mar. 13, 2008, which is incorporated hereinto by reference.

BACKGROUND OF THE INVENTION

The present invention relates to a sheet humidifying device that humidities sheets, and to an image forming system equipped with the sheet humidifying device.

In an image forming apparatus of an electrophotographic type, namely, in a copying machine, a printer, a facsimile machine and a multifunction peripheral having functions of the aforesaid items, there is a problem that a sheet is curled and is deformed to be waved because a sheet is dehydrated in the course of heating in the heating and fixing process. As a device to solve this problem, there has been suggested a technology to humidify a sheet after the sheet has been processed in terms of fixing.

Unexamined Japanese Patent Application Publication No. 2007-58026 discloses a sheet humidifying device having therein a pair of porous rollers which convey a sheet and form a nip portion and water-supply rollers which are in contact with the humidifying rollers to supply water.

Water to be supplied to a sheet is supplied to the porous rollers from the water-supply rollers. Further, supply of water to the water-supply rollers is conducted from a water-supply container in Unexamined Japanese Patent Publication No. 11-161107, wherein, water is coated on a circumference surface of the porous roller from the water-supply roller, when the water-supply roller dipped in the water-supply container is rotated.

In a process of humidifying sheets, foreign matters such as paper dusts sticking to the sheet spread from the sheet to a humidifying roller, then, from the humidifying roller to a water-supply roller, and further, from the water-supply roller to the water-supply container to be mixed to spread in a sheet humidifying device.

Then, foreign matters mixed in the aforesaid water-supply container stick again to the water-supply roller and the humidifying roller, thus, uniform humidification of water on entire surface of the sheet is interrupted by the foreign matters on the porous roller and on the water-supply roller, which is a problem.

SUMMARY OF THE INVENTION

An aspect of the invention is as follows.

A sheet humidifying device that is characterized to have a pair of humidifying rollers forming a nip portion by pressure contacting against each other and giving water to a sheet passing through the nip portion, a water-supply roller that pressure-contacts the aforesaid humidifying roller and supplies water to the humidifying roller, a water vessel that stores water to be supplied to the water-supply roller and a pressure-contact releasing section that releases pressure-contact of the paired humidifying rollers and releases pressure contact between the humidifying roller and the water-supplying roller.

Another aspect of the invention is as follows.

An image forming system characterized to have an image forming apparatus that forms an image on a sheet and a sheet humidifying device described above that gives water to the sheet on which an image is formed by the image forming apparatus.

DETAILED DESCRIPTION OF THE PREFERRED EMBODIMENT

The invention will be explained as follows, referring to the embodiment, to which, however, the invention is not limited.

[Image Forming Apparatus]

Figure 1:
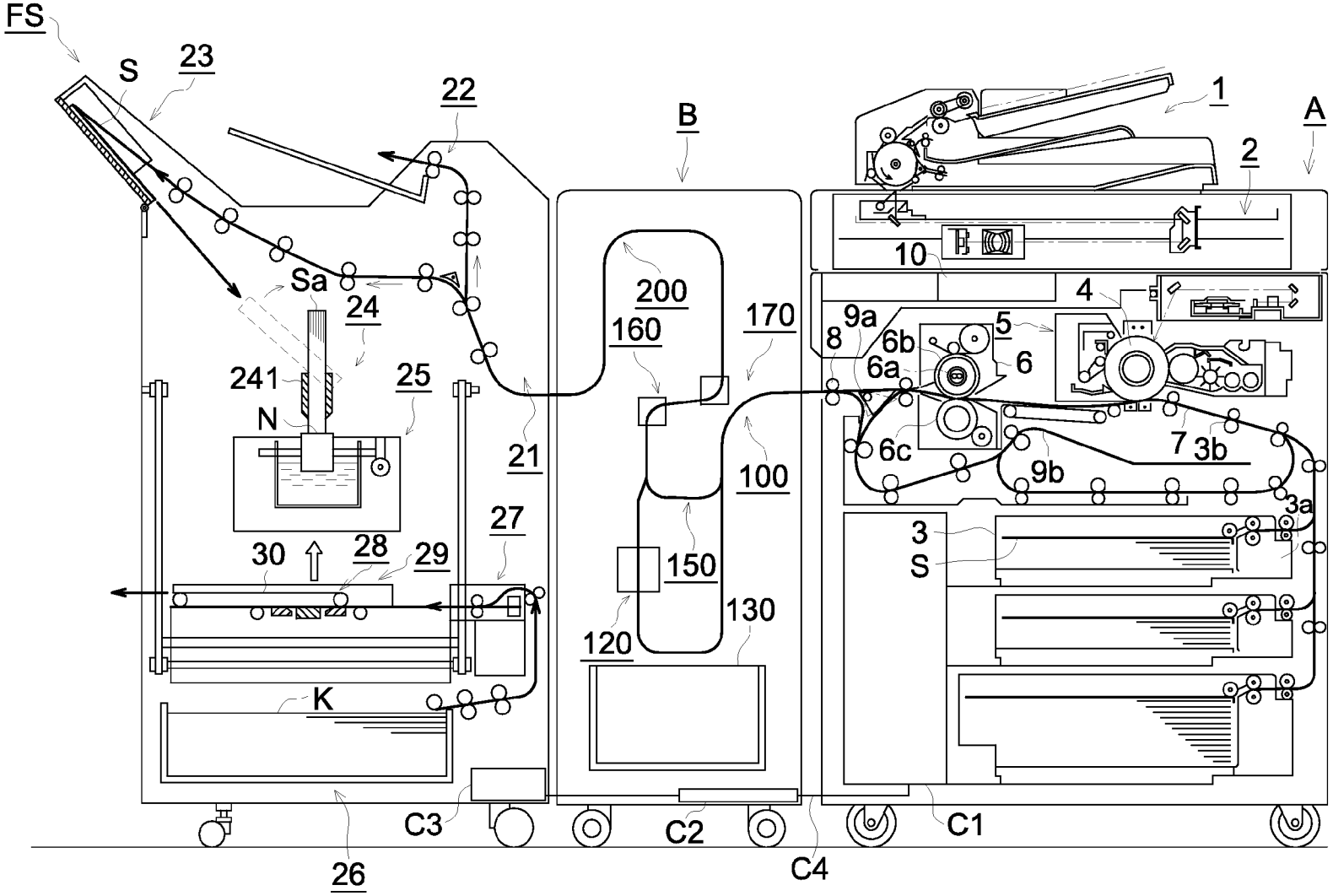
FIG. 1 is an overall diagram of an image forming system relating to an embodiment of the invention.

FIG. 1 is an overall diagram of an image forming system relating to an embodiment of the invention. The image forming system is composed of image forming apparatus A, sheet humidifying device B and sheet finisher FS.

The image forming apparatus A has, on its upper part, automatic document feeder 1 and image reading section 2, and a lower part of the image forming apparatus A is composed of a printer section.

In the printer section, the numeral 3 represents a sheet storing section that stores sheets S. In image forming unit (printer engine) 5 that forms a toner image on photoreceptor 4 through an electrophotographic process to conduct charging, exposure and development for photoreceptor 4, an image is formed on sheet S and the image thus formed is fixed by fixing unit 6. In the fixing unit 6, heat roller 6*b* housing therein heat source 6*a* and pressure roller 6*c* form a nip portion that conveys sheet S, thus, sheet S is heated and pressed, while it is conveyed, so that toner may be fused, and an image is fixed on sheet S.

The sheet S is fed by first sheet feeding unit 3*a* from sheet storing section 3, then, is fed after being stopped temporarily at second sheet feeding device 3*b*, so that image forming is conducted, and the sheet S on which an image has been formed is ejected out of an ejection outlet by sheet ejection rollers 8 to be fed to sheet humidifying device B on the left side.

As a conveyance path for sheet S, there are provided sheet feeding path 7 covering from sheet storing section 3 to image forming unit 5, conveyance path 9*a* covering from image forming unit S to a sheet ejection outlet through fixing unit 6 and sheet ejection roller 8 and rear surface conveyance path 9*b* that is for reversing conveyance.

An image forming mode includes a one-side face-down sheet ejection mode, a one-side face-up sheet ejection mode, and a two-side mode. In the one-side face-down sheet ejection mode, an image is formed on one side, and sheet S which has passed through the fixing unit 6 is conveyed by sheet ejection rollers 8 to be ejected after being reversed inside out by the reverse processing.

In the one-side face-up sheet ejection mode, an image is formed on one side, and sheet S which has been conveyed through conveyance path 9*a* is conveyed as it is by sheet ejection rollers 8 to be ejected.

In the two-side mode, an image is formed on one side and sheet S which has passed through the fixing unit 6 travels downward to advance to rear surface conveyance path 9*b*, and is fed to sheet feeding path 7 again after being reversed inside out.

In the image forming unit 5, a reverse side image is formed on the reverse side of the sheet S thus fed again, and the sheet S on which the reverse side image has been formed passes through the fixing unit 6, and is conveyed by the sheet ejection rollers 8 to be ejected.

In a continuous image forming cycle in which images are formed continuously on a plurality of sheets, plural sheets S are fed and conveyed from sheet storing section 3 at prescribed intervals, so that images are formed continuously.

The numeral 10 represents an operation section, and various types of modes in image forming apparatus main body A and an output mode employing sheet finisher FS can be established by operations in the operation section 10.

Controller C1 arranged on the image forming apparatus A is connected to controller C2 of sheet humidifying device B and to controller C3 of sheet finisher FS through communication device C4.

Sheet S ejected from the image forming apparatus A is conveyed to the sheet finisher FS through sheet humidifying device B.

The sheet humidifying device B has therein first carry-in and conveying section 100 that receives and conveys sheet S ejected from the image forming apparatus A, sheet humidifying section 120 that humidifies sheets S, second carry-in and conveying section 150 that receives and conveys sheet S ejected from the image forming apparatus A, first decurl section 160, second decurl section 170, and ejection and conveyance path 200 that ejects sheet S and delivers it to sheet finisher FS.

[Sheet Finisher FS]

The sheet finisher FS is a general term for those including a punching and folding machine, a flat binding machine, a center folding machine, a gluing and bookbinding machine and a cutting machine which conduct various types of post processing for sheets S ejected from image forming apparatus A. As an embodiment of sheet finisher FS, the gluing and bookbinding machine will be explained as follows, as representation.

The gluing and bookbinding machine is equipped with sheet introduction device 21, sheet ejection device 22, sheet bundle storing device 23, sheet bundle conveying device 24, glue coating device 25, cover sheet supply device 26, cover sheet cutting device 27, cover sheet wrapping device (case binding device) 28 and aligning device 29.

Sheet S introduced to sheet introduction section 21 is gradually conveyed downward obliquely after being placed on sheet bundle storing device 23, and is held by holding advice 241 of sheet bundle conveyance device 24. The holding device 241 rotates while holding sheet bundle Sa in which sheets S are bundled so that the back (hereinafter referred to as glue coating surface N) of the sheet bundle Sa may come to the lower side, and stops at a prescribed position. The glue coating device 25 coats glue on the spine N of the sheet bundle Sa.

Cover sheet K stored in cover sheet supply device 26 is conveyed to cover sheet wrapping section 28 through cover sheet cutting device 27, and then, a trailing edge section of the cover sheet K is cut to a prescribed length by the cover sheet cutting device 27. A length to which the cover sheet K is cut is one wherein a thickness of a spine of sheet bundle Sa is added to a length equivalent to two sheets S in their traveling direction.

The cover sheet wrapping section 28 receives cover sheet K supplied from the cover sheet supply section 26 and conveys it to conduct positioning in the lateral direction by aligning device 29, after stopping at a prescribed position. The cover sheet wrapping device 28 pressure contacts glue coating surface N of sheet bundle Sa to be glued.

The cover sheet K is folded along a side edge of glue coating surface N of sheet bundle Sa, by a descent of a pressure member that faces a spine of sheet bundle Sa and by a movement of a pair of folding members which are bilaterally symmetrical arranged on the upper portion of the cover sheet wrapping section 28, thus, sheet bundle Sa on which cover sheets K are mounted respectively on a surface and the reverse thereof is formed.

After an end of the folding process for cover sheet K, the cover sheet wrapping device 28 descends to retract, and then, ejection belt 30 that has been retreated toward the outside in the width direction of cover sheet K together with retreating of aligning section 29 moves to the inner side in the width direction at the lower part of sheet bundle Sa to stop. After that, when interposing by holding member 241 is released, the sheet bundle Sa descends and stops at the position where a lower spine of the sheet bundle Sa comes in contact with an upper surface of ejection belt 30. The rotating ejection belt 30 ejects a booklet bound after sticking cover sheet K to sheet bundle Sa out of an apparatus.

[Sheet Humidifying Device]

Figure 2:
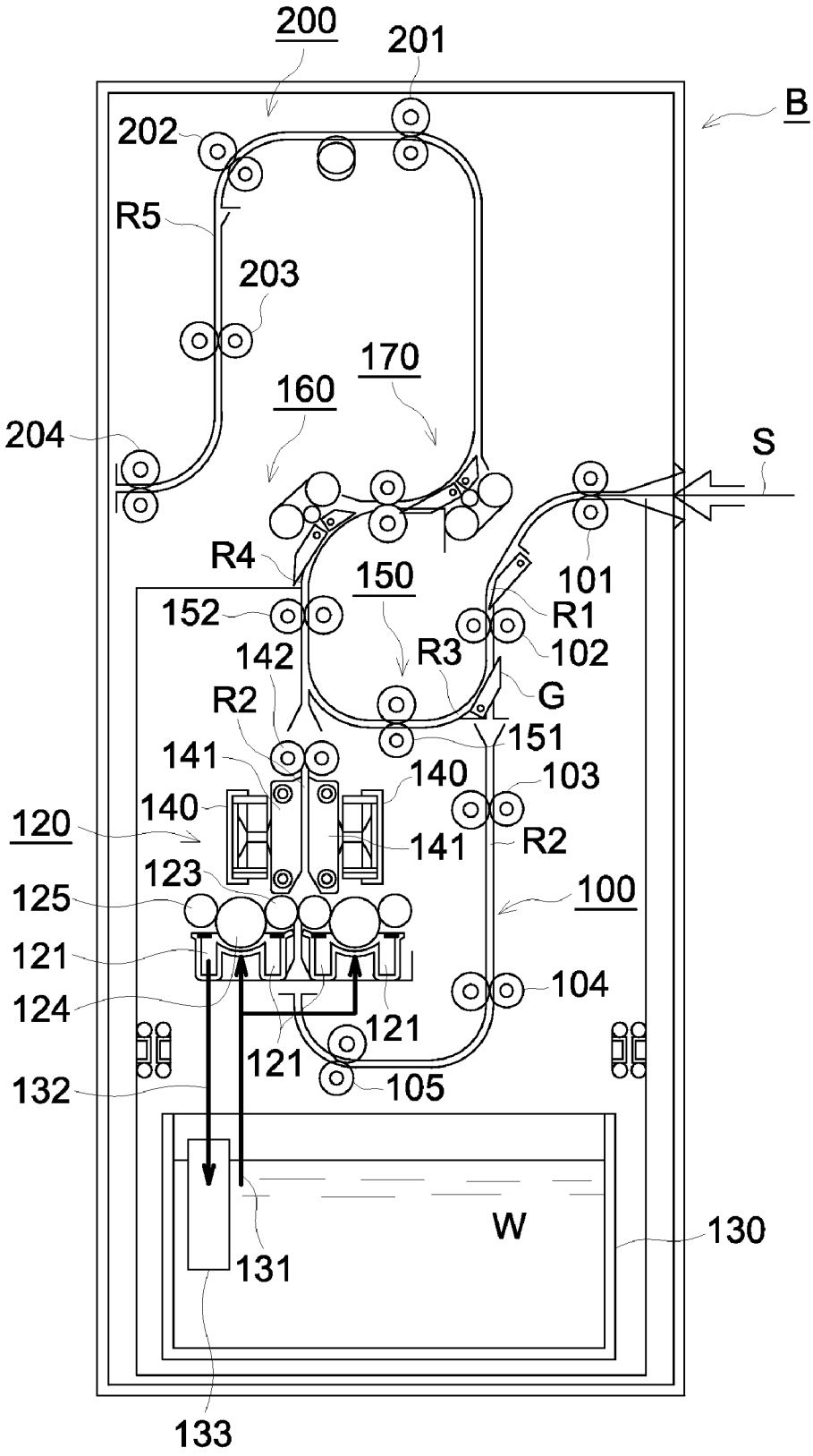
FIG. 2 is an overall diagram of sheet humidifying device B relating to an embodiment of the invention.

FIG. 2 is an overall diagram of sheet humidifying device B relating to an embodiment of the invention. In the sheet humidifying device B, sheets which are curled or deformed to be wavy in image forming apparatus A are corrected.

First receiving and conveying section 100 has conveyance path R1, sheet humidifying section 120 has conveyance path R2, second receiving and conveying section 150 has conveyance path R3, first to third decurl sections 160, 170 and 180 have conveyance path R4 and ejection and conveyance path 200 has conveyance path R5.

Conveyance paths R1 to R5 are formed by plural guide members as illustrated.

A part of conveyance path R1 is shared by first and second carry-in and conveyance sections 100 and 150.

Sheet S received by sheet humidifying device B is conveyed, through switching operations of switching gate G, to first decurl section 160 through first receiving and conveying section 100 and second receiving and conveying path 150 to be ejected through second decurl section 170, third decurl section 180 and ejection and conveyance section 200, or the sheet S is conveyed to sheet humidifying section 120 from the first receiving and conveying section 100, to be ejected out from sheet humidifying section 120 through second receiving and conveying section 150, first to third decurl sections 160, 170 and 180 and ejection and conveyance section 200.

In the first receiving and conveying section 100, the sheet S is conveyed by conveyance rollers 101 to 105 to be conveyed to sheet humidifying section 120.

In the sheet humidifying section 120, the sheet S is conveyed by humidifying rollers 123 and by conveyance rollers 142.

In the second receiving and conveying section 150, the sheet S is conveyed by conveyance rollers 101, 102, 151 and 152.

In the ejection and conveyance section 200, the sheet S is conveyed by conveyance rollers 201 to 204 and is ejected.

Next, each processing section of sheet humidifying device B will be explained.

[Sheet Humidifying Section 120]

Figure 3:
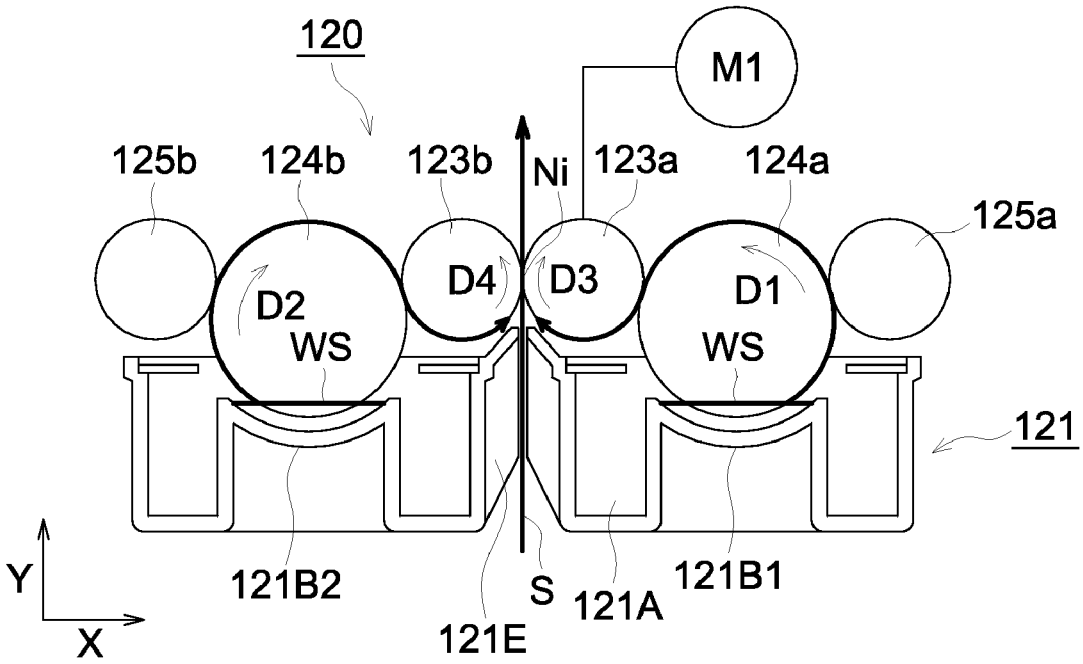
FIG. 3 is a diagram showing the structure of sheet humidifying section 120.

A structure and a function of sheet humidifying section 120 will be explained as follows, referring to FIGS. 1-3. FIG. 3 is a diagram showing the structure of sheet humidifying section 120.

The sheet humidifying section 120 has therein a pair of humidifying rollers 123 (123*a* and 123*b*), two water-supply rollers 124 (124*a* and 124*b*), control rollers 125 (125*a* and 125*b*) and water vessel 121. The two humidifying rollers 123 are arranged on a bilateral symmetry basis in a horizontal direction (X direction in the illustration) with nip portion Ni serving as their center, and the two water-supply rollers 124 are arranged on a bilateral symmetry basis in a horizontal direction (X direction in the illustration) with nip portion Ni serving as their center.

Water vessel 121 storing therein water for humidifying sheets forms water tank 121A that is slightly longer than the maximum width (sheet length in the direction perpendicular to the conveyance direction) of sheet S to be conveyed.

In the water vessel 121, there are formed water-supply trays 121B1 and 121B2 which are arranged side by side. The water-supply trays 121B1 and 121B2 form a chamber that stores water at the position that is higher than the water tank 121A formed by the water vessel 121. With respect to water to be stored in the water-supply trays 121B1 and 121B2, water exceeding a height of wall surfaces on both sides of the water-supply trays 121B1 and 121B2 overflows and falls in water tank 121A. On the central portion of the water vessel 121, there is formed slit 121E through which the sheet S passes.

Each of two water-supply trays 121B1 and 121B2 has a circular-arc-shaped inner circumferential surface which corresponds to each of cylinder-shaped outer circumferential surfaces of water-supply rollers 124*a* and 124*b*.

Water having passed through supply-water pipe 131 is supplied from lower reservoir 130 to water-supply trays 121B1 and 121B2, and constant water level WS is kept because water exceeding to become equal to or higher than wall surfaces on both sides overflows.

On the upper portions of the water-supply trays 121B1 and 121B2, there are arranged water-supply rollers 124*a* and 124*b* which are arranged to be away from an inner circumferential surface of the water-supply tray 121B by a prescribed distance, and lower portions of water-supply rollers 124*a* and 124*b* are dipped in water stored in the water-supply trays 121B1 and 12182.

Each of the water-supply rollers 124*a* and 124*b* is composed of a rubber roller wherein a rubber layer is formed on a metal core, and the water-supply roller 124*a* rotates in the direction shown with arrow D1 and the water-supply roller 124*b* rotates in the direction shown with arrow D2.

Humidifying roller 123*a* is arranged in a way to come in contact with water-supply roller 124*a*, and humidifying roller 123*b* that is in contact with water-supply roller 124*b* is arranged, and the humidifying roller 123*a* and the humidifying roller 123*b* come in pressure contact (that is called also pressure bonding) with each other to form nip portion Ni. On a shaft of each of control rollers 125*a* and 125*b*, there is provided pressure pointing to the central nip portion Ni by an elastic body such as a spring (an arrow direction in FIGS. 4(*a*)-4(*b*) which will be described later). Further, both ends of a roller shaft for each of humidifying roller 123, water-supply roller 124 and control roller 125 are supported by unillustrated panels through bearings, thus, these rollers can move in the x direction when the bearings move along elongated circles provided on the panels.

The humidifying roller 123 is composed of a rubber roller wherein a rubber layer is formed on a metal core, and the humidifying roller 123*a* rotates in the direction shown with arrow D3, and the humidifying roller 123*b* rotates in the direction shown with arrow D4, thus, sheet S is interposed and conveyed upward in the Y direction as is illustrated at the nip portion Ni where a circumferential surface of the humidifying roller 123 and a circumferential surface of the humidifying roller 123 are brought into contact with each other.

Either one of the paired humidifying rollers 123 is driven by a driving source to rotate to function as a drive roller. In the example shown in FIG. 3, drive motor M1 drives humidifying roller 123*a* to rotate. Then, the other rollers, i.e., the humidifying roller 123*b*, water-supply rollers 124 and control rollers 125 are driven to rotate by the rotation of the drive roller.

Control roller 125 that comes in contact with water-supply roller 124 functions as a regulating member that comes in contact with the water-supply roller 124, to regulate moisture content on the surface of the water-supply roller 124. The control roller 125 is made of a metal cylinder body, and it is driven to rotate by water-supply rollers 124.

Water W is supplied from reservoir 130 by a pump (not shown) to water-supply trays 121B1 and 121B2 of water vessel 121 through water-supply pipe 131, and is returned to the reservoir 130 from water vessel 121 through drain pipe 132.

The numeral 133 represents a filter, and foreign substances such as paper dust mixed in water W in the course of humidifying sheets, are filtered by filter 133, and water W circulates between reservoir 130 and water vessel 121.

Next, humidification of sheet S will be explained. Sheet S is carried in sheet humidifying section 120 by conveyance roller 105, and it passes through slit 121E to be conveyed by a pair of humidifying rollers 123. Water W is supplied to outer circumferential surfaces of humidifying rollers 123 from water vessel 121 through water-supply roller 124, and sheet S is humidified continuously in the process of conveyance.

On the outer circumferential surface of water-supply roller 124, there is formed uniform water film which is further uniformalized by a regulating roller.

In the course of humidifying sheets, foreign substances such as paper dust adhere to humidifying roller 123 from sheet S and further mix in water W, but foreign substances mixed in water W are filtered out by filter 133.

[Pressure Contact and Releasing By Pressure-Contact Releasing Section]

Figure 4:
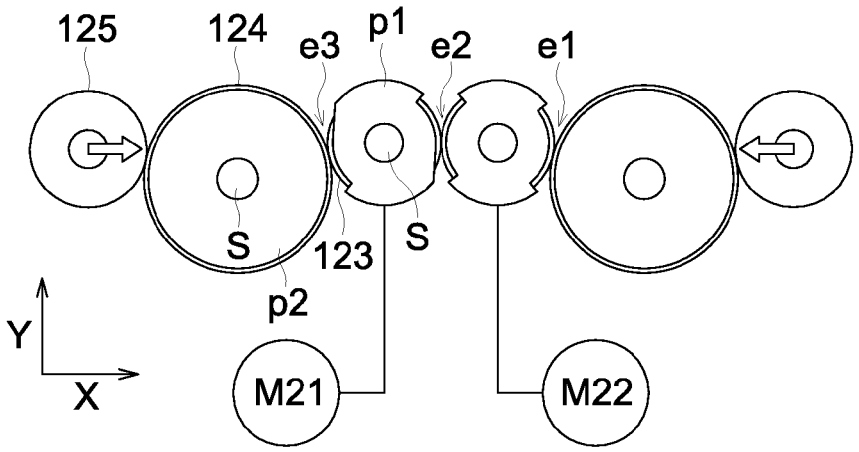
FIGS. 4(*a*) and 4(*b*) are pattern diagrams for illustrating pressure contact releasing by a pressure contact device, and FIG. 4(*a*) is a diagram showing the state of pressure contact and FIG. 4(*b*) is a diagram showing the state of releasing of pressure contact.
Figure 4:
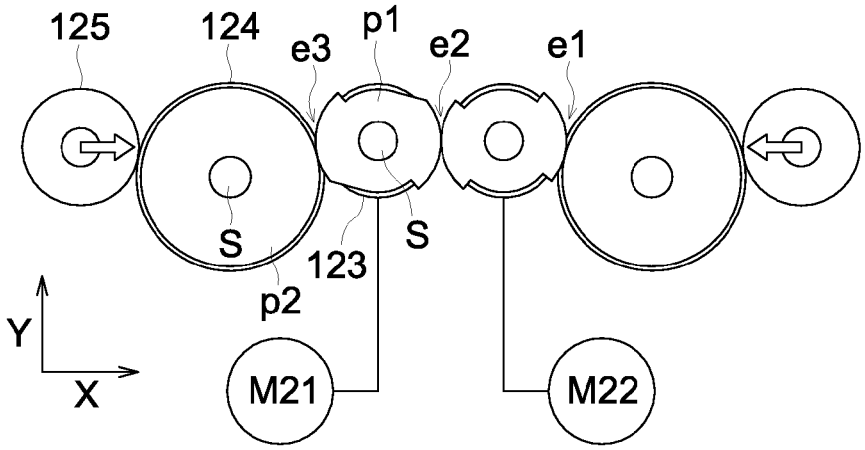

FIGS. 4(*a*)-4(*b*) show pattern diagrams for illustrating releasing of pressure contact by a pressure-contact releasing section. Each of the diagrams is a sectional view of sheet humidifying section 120 and its periphery which are viewed from an edge portion on this side on the front. Incidentally, since the diagrams are on a bilateral symmetry basis, symbols are given only to the left side. Further, an edge portion in the inner part has the same structure, though an illustration thereof is omitted. FIG. 4(*a*) is a diagram showing the state of pressure contact and FIG. 4(*b*) is a diagram showing the state of releasing where the pressure contact is released by the pressure-contact releasing section. In the meantime, in the present embodiment, drive motors M21, M22, cam plate p1 and driven plate p2 are integrated to function as "a pressure-contact releasing section".

In FIG. 4(*a*), p1 represents a cam plate that is rotated by drive motor M21 and M22 respectively. Further, each of the drive motors M21 and M22 is a stepping motor, and both drive motors are controlled so that they rotate by the same rotation angle (pulse number) in opposite directions each other in synchronization.

In the state of pressure contact shown in FIG. 4(*a*), cam plate p1 is the initial state wherein non-contact state is kept between cam plates p1 and between cam plate 1 and driven plate p2. In the pressure contact state, adjoining humidifying roller 123 and water-supply roller 124 are brought into pressure contact by pressure of outer control roller 125 in contact sections e1 and e3, and humidifying rollers 123 are brought into pressure contact by pressure of outer control roller 125 in contact sections e2.

FIG. 4(*b*) is a diagram showing the state of releasing of pressure contact wherein cam plate p1 on the left side is rotated counterclockwise and cam plate p1 on the right side is rotated in the clockwise, by operating drive motors M21 and M22 respectively. In the released state, cam plates p1 are in contact each other, and cam plate p1 and driven plate p2 are in contact each other. Based on the foregoing, adjoining humidifying roller 123 and water-supply roller 124 are in the state of non-contact (state of separating), namely, in the released state, by resisting pressure of outer control roller 125 in contact sections e1 and e3, and humidifying rollers 123 are in the state of non-contact (state of separating), namely, in the released state, by resisting pressure of outer control roller 125 in contact section e2.

In the present embodiment, it is possible to remove properly foreign substances sticking to the surface of humidifying roller 123 and water-supply roller 124, by conducting pressure contact releasing operations (which are also called pressure clamping releasing operations) between two humidifying rollers 123 and between humidifying roller and water-supply roller 124, by a pressure contact releasing section in sheet humidifying apparatus B. Therefore, foreign substances hardly stick to humidifying roller 123 and to water-supply roller 124, and it is possible to provide a sheet humidifying apparatus capable of giving water to sheet S uniformly for a long time.

Further, as shown in FIG. 3, two humidifying rollers 123 and two water-supply rollers 124 are arranged on a bilateral symmetry basis in a horizontal direction with nip portion Ni serving as their center, thus, humidifying efficiency for sheet S by humidifying roller 123 on the left side can easily be made to be the same as that by humidifying roller 123 on the right side, resulting in uniform humidification on both sides of sheet S, which makes it possible to correct properly the troubles such as curling of sheet S.

[operation Timing of Pressure Contact Releasing Section]

Figure 5:
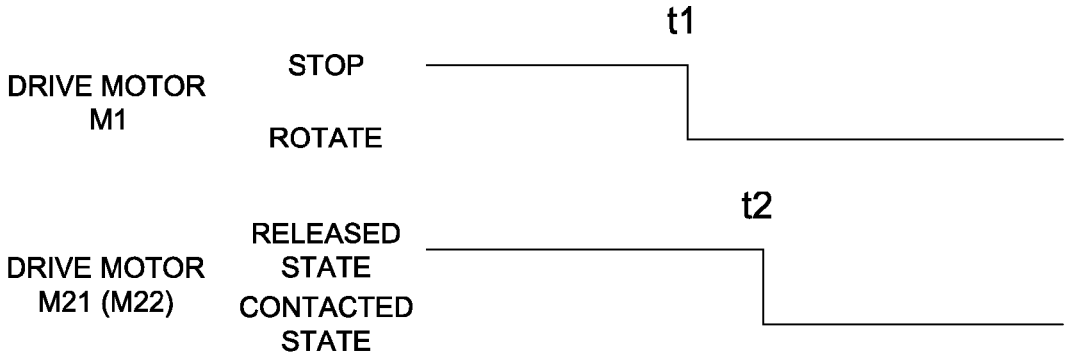
FIG. 5 is a time chart for illustrating operation timing for drive motor M1 and drive motor M21 in the start of rotating.

FIG. 5 is a time chart for illustrating operation timing for drive motor M1 and drive motor M21 (M22) in sheet humidifying device B at the start of rotating. Incidentally, in FIG. 5, drive motor M21 and drive motor M22 are synchronized with each other. As stated above, drive motor M1 drives humidifying roller 123 of sheet humidifying section 120, and drive motors M21 and M22 are those which release pressure contact between respective rollers. In FIG. 5, controller C2 starts drive motor M1 to rotate at t1 timing, and then, changes an angle of cam plate p1 by driving drive motor M21 at t2 timing thereafter by an amount equivalent to prescribed pulses, and thereby changes respective rollers of sheet humidifying section 120 from the released state shown in FIG. 4(*b*) to the state of pressure contact shown in FIG. 4(*a*). In other words, respective rollers are brought into pressure contact during the period of rotation of humidifying roller 123.

By doing this, gripping powers in the case of pressure connection between humidifying rollers 123 and between the humidifying roller and water-supply roller 124 work, whereby, foreign substances sticking to surfaces of humidifying roller 123 and water-supply roller 124 can be removed more efficiently, which makes it possible to provide a sheet humidifying device capable of giving water to sheet S uniformly for a long time.

Figure 6:
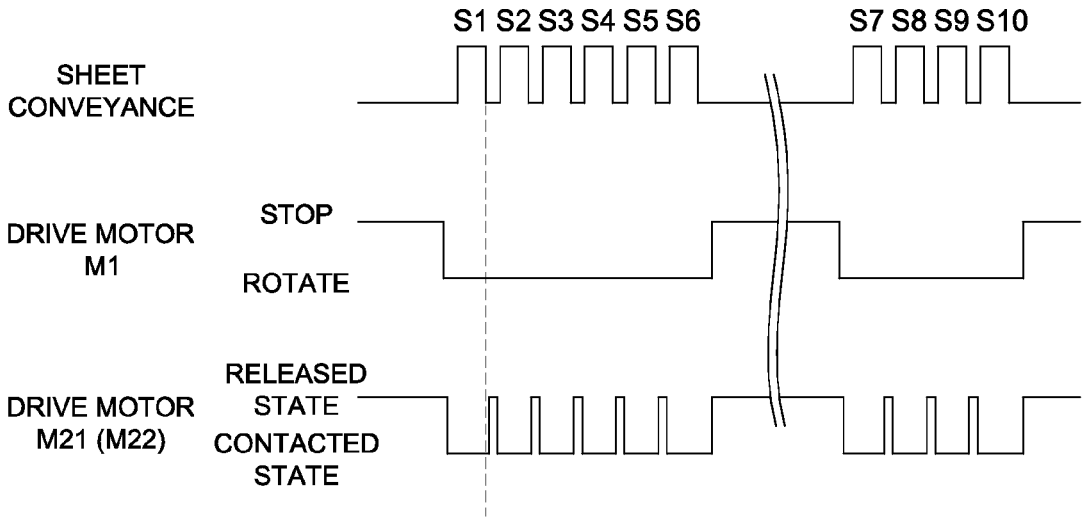
FIG. 6 is a time chart for illustrating operation timing for a pressure contact releasing section in sheet humidifying device B, in the course of continuous image forming cycle in which images are formed continuously on a plurality of sheets.

FIG. 6 is a time chart for illustrating operation timing for a pressure contact releasing section in sheet humidifying device B, in the course of continuous image forming cycle in which images are formed continuously on a plurality of sheets. In a sheet conveyance section in FIG. 6, there are indicated timing points each showing timing for sheet S to pass through nip portion Ni of sheet humidifying section 120. In FIG. 6, there are shown operations in a continuous image forming cycle that forms images for sheets S in total 10 sheets including six consecutive sheets and four consecutive sheets following the six sheets. In the meantime, conveyance timing for sheet S is detected by a sheet passing detection sensor of an unillustrated actuator type provided on sheet humidifying device B.

As shown in FIG. 6, controller C2 controls the pressure contact releasing section so that pressure contact may be released until the moment just before each of the forefront sheets (S1 and S7) arrives at nip portion Ni formed by a pair of humidifying rollers 123.

Further, in the continuous image forming cycle, the controller C2 controls a pressure contact releasing section so that pressure contact of a pair of humidifying rollers 123 may be released between the sheet and the sheet. Incidentally, in the example shown in FIG. 6, there is shown an example wherein control is made so that pressure contact releasing operation may be conducted between all sheets. However, the invention is not limited to this, and when an interval between the sheets for one side continuation for A4 size in a continuous image forming cycle is short, it is also possible to control so that pressure contact releasing operations may be carried out only for the occasion where an interval between sheets to continue both sides or different sheet sizes is long, without conducting pressure contact releasing operations.

By controlling in the aforesaid way, foreign substances sticking to the surfaces of humidifying roller 123 and of water-supply rollers 124 can be removed more efficiently, and it is possible to provide a sheet humidifying device that can give water to sheet S evenly for a long time.

What is claimed is:

1. A sheet humidifying device comprising:

a pair of humidifying rollers which form a nip portion by pressure contacting against each other, and which are adapted to provide water to a sheet passing through the nip portion;

a water-supply roller that pressure contacts at least one of the pair of humidifying rollers and supplies water to the at least one of the pair of humidifying rollers;

a water vessel that stores water to be supplied to the water-supply roller;

a pressure-contact releasing section that releases pressure-contact between the pair of humidifying rollers and releases pressure-contact between the at least one of the pair of humidifying rollers and the water-supply roller;

a controller which controls the pressure-contact releasing section so that after a drive motor starts to rotate at least one of the pair of humidifying rollers, a state of the pair of humidifying rollers and the water-supply roller is changed from a released state to a state of pressure contact, thereby bringing the pair of humidifying rollers as well as the at least one of the pair of humidifying rollers and the water-supply roller into pressure contact with each other;

an additional water-supply roller, wherein the two water-supply rollers are respectively provided to be in pressure contact with the pair of humidifying rollers, and wherein the pair of humidifying rollers and the two water-supply rollers are arranged on a bilateral symmetry basis in a horizontal direction with the nip portion serving as a center; and a pair of outer control rollers, wherein pressure of the pair of outer control rollers brings the pair of humidifying rollers as well as the pair of humidifying rollers and the two water-supply rollers into the state of pressure contact;

wherein the pressure-contact releasing section comprises a pair of cam plates, a pair of driven plates, and a pair of drive motors;

wherein the pair of drive motors respectively rotate the pair of cam plates to bring the pair of humidifying rollers and the two water-supply rollers in the state of pressure contact or in the released state; and wherein in the released state, the pair of cam plates are in contact with each other, and the pair of driven plates are respectively in contact with the pair of cam plates.

2. An image forming system comprising:

an image forming apparatus that forms an image on a sheet; and the sheet humidifying device of claim 1, wherein the sheet humidifying device provides water to the sheet on which the image has been formed by the image forming apparatus.

3. The image forming system of claim 2, wherein the controller controls the pressure-contact releasing section in a continuous image forming cycle in which an image forming operation is carried out continuously on a plurality of sheets, and the sheets are then conveyed so that the pair of humidifying rollers are changed to the state of pressure contact just before a forefront of each of the sheets arrives at the nip portion formed by the pair of humidifying rollers.

4. The image forming system of claim 3, wherein in the continuous image forming cycle, the controller controls the pressure-contact releasing section so that the pressure contact of the pair of humidifying rollers is released between adjoining sheets.

* * * * *